US007066505B2

(12) United States Patent
Van Klompenburg et al.

(10) Patent No.: US 7,066,505 B2
(45) Date of Patent: Jun. 27, 2006

(54) COMBINATION FOLDING CRANK HANDLE AND LOCK

(75) Inventors: Marlo Van Klompenburg, Pella, IA (US); Bruce Baier, Pella, IA (US); Matt Van Dyne, Oskaloosa, IA (US); John M. Mitchell, Murray, KY (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 10/393,473

(22) Filed: Mar. 20, 2003

(65) Prior Publication Data

US 2004/0183314 A1 Sep. 23, 2004

(51) Int. Cl.
*E05B 3/00* (2006.01)

(52) U.S. Cl. ..... 292/336.3; 49/339

(58) Field of Classification Search ..... 292/336.3, 292/DIG. 20, DIG. 47; 49/339, 341, 345, 49/346, 460

See application file for complete search history.

(56) References Cited

U.S. PATENT DOCUMENTS

| | | | | | |
|---|---|---|---|---|---|
| 4,617,758 | A | | 10/1986 | Vetter | |
| 4,860,493 | A | | 8/1989 | Lense | |
| 4,932,691 | A | * | 6/1990 | White | 292/38 |
| 4,932,696 | A | * | 6/1990 | White | 292/336.3 |
| 4,937,976 | A | * | 7/1990 | Tucker et al. | 49/345 |
| 5,054,239 | A | | 10/1991 | Tucker et al. | |
| 5,095,614 | A | | 3/1992 | Kautt | |
| 5,152,103 | A | | 10/1992 | Tucker et al. | |
| 5,168,770 | A | * | 12/1992 | Ellis | 74/545 |
| RE34,230 | E | | 4/1993 | Tucker et al. | |
| 5,400,473 | A | | 3/1995 | Delman | |
| 5,410,778 | A | | 5/1995 | Langevin | |
| 5,467,503 | A | | 11/1995 | Nolte et al. | |
| 5,493,813 | A | * | 2/1996 | Vetter et al. | 49/341 |
| 5,509,234 | A | | 4/1996 | Klimek et al. | |
| 5,531,045 | A | | 7/1996 | Piltingsrud | |
| 5,560,082 | A | | 10/1996 | Vetter | |
| 5,603,538 | A | | 2/1997 | Evers | |
| 5,740,632 | A | * | 4/1998 | Peterson et al. | 49/460 |
| 5,829,802 | A | * | 11/1998 | Anderson et al. | 292/336.3 |
| 5,839,229 | A | * | 11/1998 | Briggs et al. | 49/246 |
| 5,937,582 | A | * | 8/1999 | Taylor | 49/341 |
| 6,006,478 | A | | 12/1999 | Hübner et al. | |
| 6,164,156 | A | | 12/2000 | Purcell | |
| 6,450,554 | B1 | * | 9/2002 | Rotondi et al. | 292/158 |
| 2002/0066162 | A1 | | 6/2002 | Klompenburg et al. | |

* cited by examiner

*Primary Examiner*—Gary Estremsky
(74) *Attorney, Agent, or Firm*—Faegre & Benson LLP

(57) ABSTRACT

A window handle assembly for use with a window having a moveable sash. The assembly including a window handle having a pivot mechanism. The handle pivotable at the pivot mechanism between open and closed positions. When open, the handle is free to rotate to move the sash between open and closed positions. When closed, the handle engages a cover to provide a sleek, aesthetically pleasing handle structure for the window. The assembly also including a lock activating mechanism coupled to the pivot mechanism and operationally couplable to a sash lock mechanism. The lock activating mechanism configured to operate the sash lock upon pivoting movement of the window handle. Opening of the handle opens the lock and closing the handle closes the lock. This mechanism including a sliding bar connectable to the sash lock and a movement mechanism causing sliding movement of the bar upon pivoting movement of the pivot mechanism.

61 Claims, 11 Drawing Sheets

COMBINATION FOLDING CRANK HANDLE AND LOCK

FIELD OF THE INVENTION

This invention relates to crank handles for windows, in particular to rotating window handles combining an opening/closing function with a locking function.

BACKGROUND OF THE INVENTION

Casement windows employ a sash that swings open and closed about an upright axis along one vertical edge of the sash. Rotating operator assemblies for effecting that swinging motion have been available for many years in various forms. See, for example, U.S. Pat. Nos. 4,392,330 and 5,006,766 owned by the assignee of the present invention. Folding crank handles on such operator assemblies have also been commercially available for some time. However, such earlier arrangements have not been optimal with respect to aesthetics, ease of use, lack of interference with window treatments, reliability and other factors.

In addition, casement windows typically employ a locking mechanism including one or more locking locations on a vertical side of the sash opposite to the side containing the axis. One or more lock activation mechanisms are then provided on the user side of the window to engage the locking mechanisms and lock the sash in place so that it cannot be swung open. One embodiment of a casement sash locking mechanism is shown and described in U.S. Pat. No. 5,603,538, having the same assignee as the present invention, which is herein incorporated by reference in its entirety. Thus, motion of the window sash and locking of the sash normally require two distinct actions at two separate locations on the window.

There have been a number of attempts at combining the sash movement and locking functions as part of the window operator. These combined operators function so that initial rotation of the operator handle of a closed window unlocks the sash from the window frame and subsequent rotation causes the sash to open. Often, rotation of the handle in an opposite direction causes the sash to close and then subsequently lock. Other combined window operators use a folding handle that has been adapted to use the folding action as part of the locking mechanism.

Unfortunately, many of these prior designs fail to overcome problems with the window operators or introduce new problems not found in earlier and less complex designs. Accordingly, the present invention is provided to overcome these deficiencies in the prior art and to furnish additional benefits.

SUMMARY OF THE INVENTION

The combination folding crank handle and locking of the present invention provides a sleek, aesthetically pleasing window handle assembly including a folding handle structure in combination with a novel locking mechanism activated by folding of the handle. The window handle assembly is usable with a window having a moveable sash, such as casement or awning type windows. The assembly includes a window handle having a pivot mechanism that provides pivoting movement of the handle between two positions, open and closed. When open, the handle is free to rotate to move the sash open and closed through a connection with a sash hinging mechanism. When closed, the handle is set within a mating cover providing a sleek, flush outer cover surface that is aesthetically pleasing and provides many benefits.

The assembly also includes a lock activating mechanism coupled to the window handle pivot mechanism. The lock activating mechanism is configured to be coupled to a sash lock mechanism through a sliding bar that is moved linearly when the lock activating mechanism is operated through pivoting movement of the handle. When the handle is moved into the open position, the lock activating mechanism is moved to unlock the sash. When the handle is moved into the closed position, the lock activating mechanism is moved in an opposite direction to lock the sash.

DETAILED DESCRIPTION OF THE INVENTION

Figure 1:
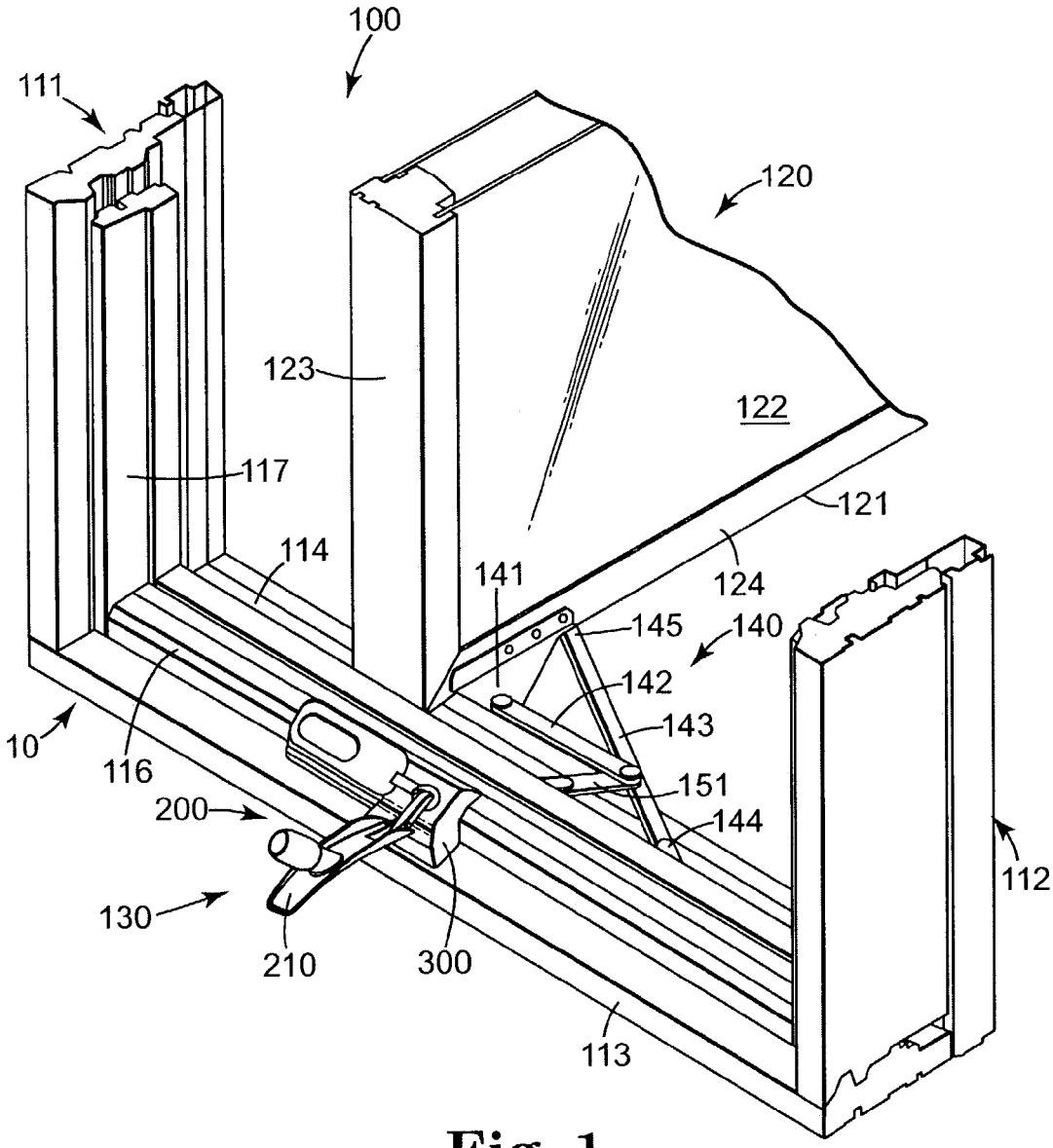
FIG. 1 is a partial perspective view of a window including a moveable sash and a combination sash operator and locking mechanism in accordance with the present invention, shown with a handle in the open position.
Figure 2:
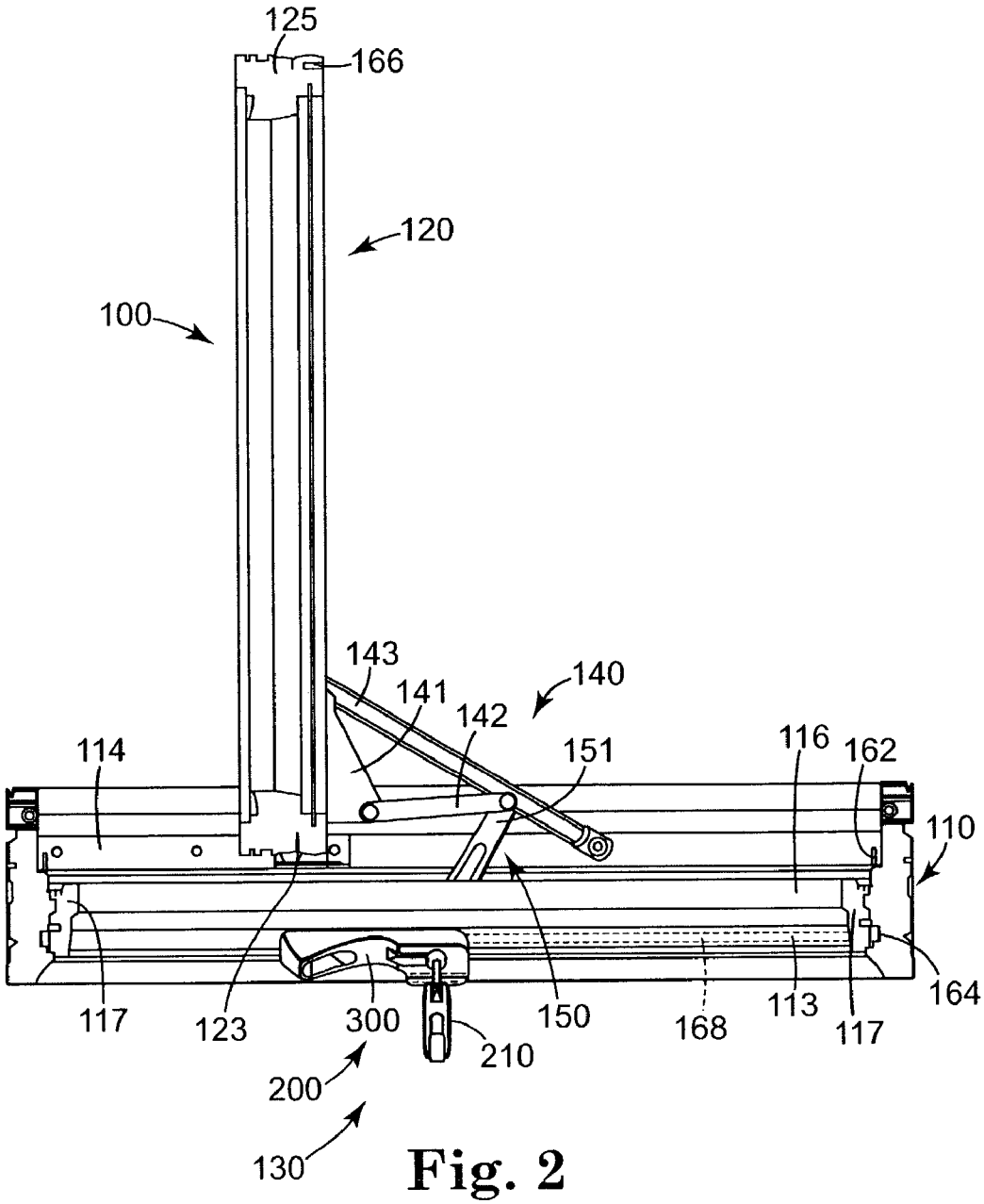
FIG. 2 is a top view of the window of FIG. 1 shown with the sash open.

With reference to the attached Figures, it is to be understood that like components are labeled with like numerals throughout the several Figures. FIGS. 1 and 2 show a window 100, including a moveable sash 120. The window 100 also includes a frame 110 formed from side frame members 111, 112 and a bottom sill member 113.

The sash 120 is formed from a frame 121 and one or more pieces of glass 122 (or other suitable viewing material). The sash 120 is moveable between open and closed positions by swinging about an axis formed within a side frame member 123. This type of window is typically known as a casement window. In this embodiment, the side frame member 123 is shifted left and right along a track 114 on sill 113 as sash 120 is open and closed. It is to be understood, however, that in another embodiment, the moveable sash may not shift the side frame member as it swings open, but would instead swing open about a stationary side frame member. Alternatively, the sash may swing open about an axis in a top frame member, such that the bottom of the sash swings outward. This type of window is typically known as an awning window. An operator assembly, broadly denoted by the numeral 130, is operably coupled with sash 120, so as to open and close the sash 120.

Figure 3:
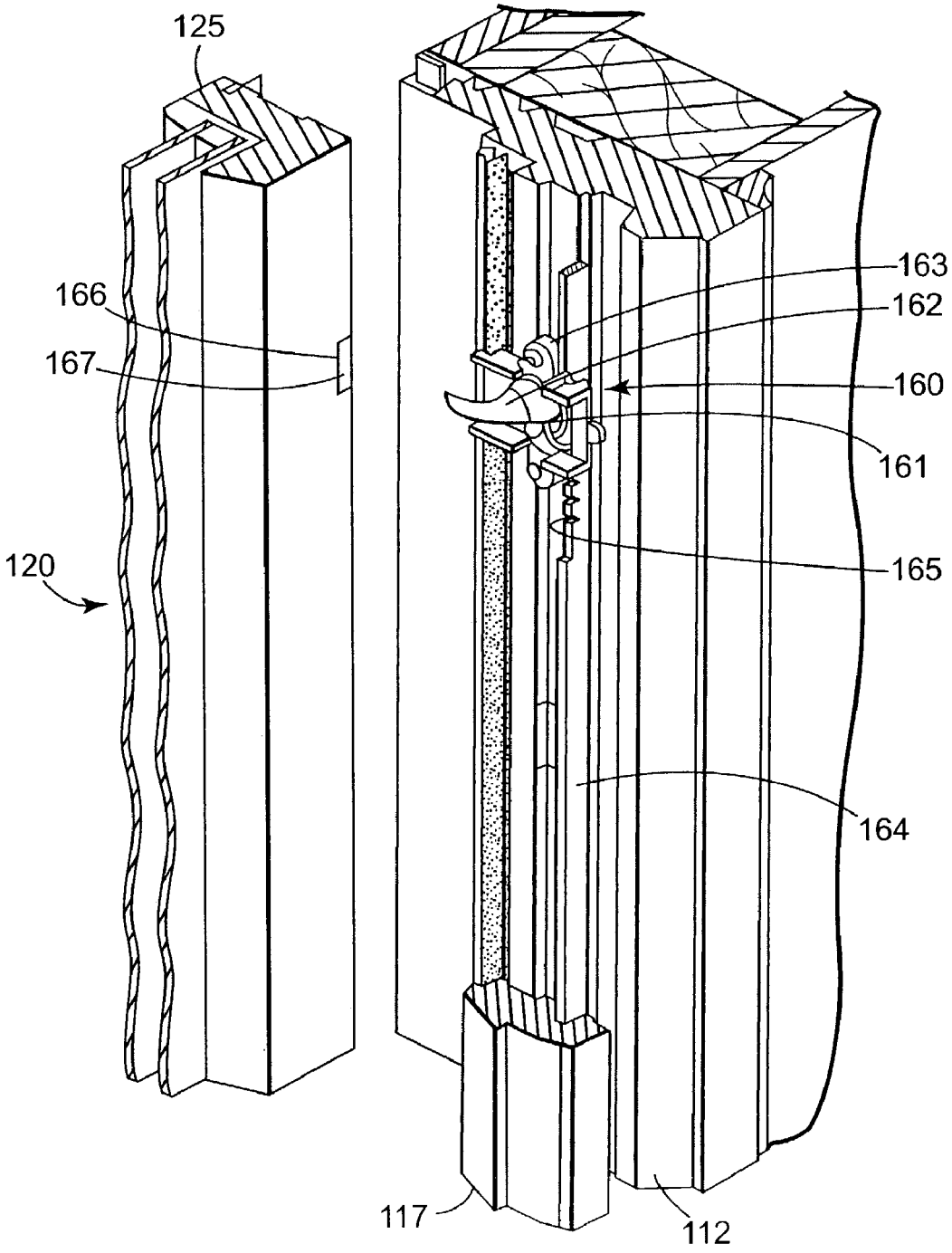
FIG. 3 is a partial perspective view of a side frame and sash of the window shown in FIGS. 1 and 2, including a lock mechanism.

Many windows of a type similar to window 100 include locks to secure the sash 120 to the frame 110, so as to restrain the sash from opening at undesired moments. Referring now also to FIG. 3, a sash lock 160 includes a hook 162 rotationally mounted in a bracket 163 against side frame 112 of window 100. A driving device 161 is included to produce the rotation of hook 162 between locked and unlocked positions. A vertical sliding lock bar 164 is provided along side frame 112 to transfer motion to the driving device 161 from a locking mechanism (not shown) remotely positioned on window 100. A trim piece 117 is also provided to cover over the sliding lock bar and related structure for aesthetic reasons. On the sash 120, a lock receptor 166 is provided on a side frame member 125 that swings outward and inward upon operation of the operator assembly 130. The lock receptor 166 includes a slot or other suitable opening 167 for receiving the hook 162. The lock receptor 166 also includes structure (not shown) to which the hook 162 is removably secured upon locking of the sash 120. One embodiment of a typical casement window sash lock mechanism is illustrated in co-owned U.S. Pat. No. 5,603,538 to Evers, entitled CASEMENT WINDOW SASH LOCKING SYSTEM.

The operator assembly 130 of the present invention includes three major subassemblies, including a sash hinging mechanism 140, a sash drive mechanism 150 (shown in FIG. 4) and a novel window handle assembly 200. The sash hinging mechanism 140 includes sash bracket 141 that is secured to the inside face of a lower frame member 124 of sash 120. Bracket 141 is pivotally connected to a linkage bar 142 that pivotally couples the sash 120 to the sash drive mechanism 150 at link arm 151. In addition, a strut 143 is pivotally connected at an inner end 144 to sill 113 and at an outer end 145 to the underside of sash frame member 124. The strut 143 assists linkage bar 142 in causing the sash 120 to swing and the pivot axis of the sash 120 to shift along sill 113 during opening and closing of the sash 120.

Figure 4:
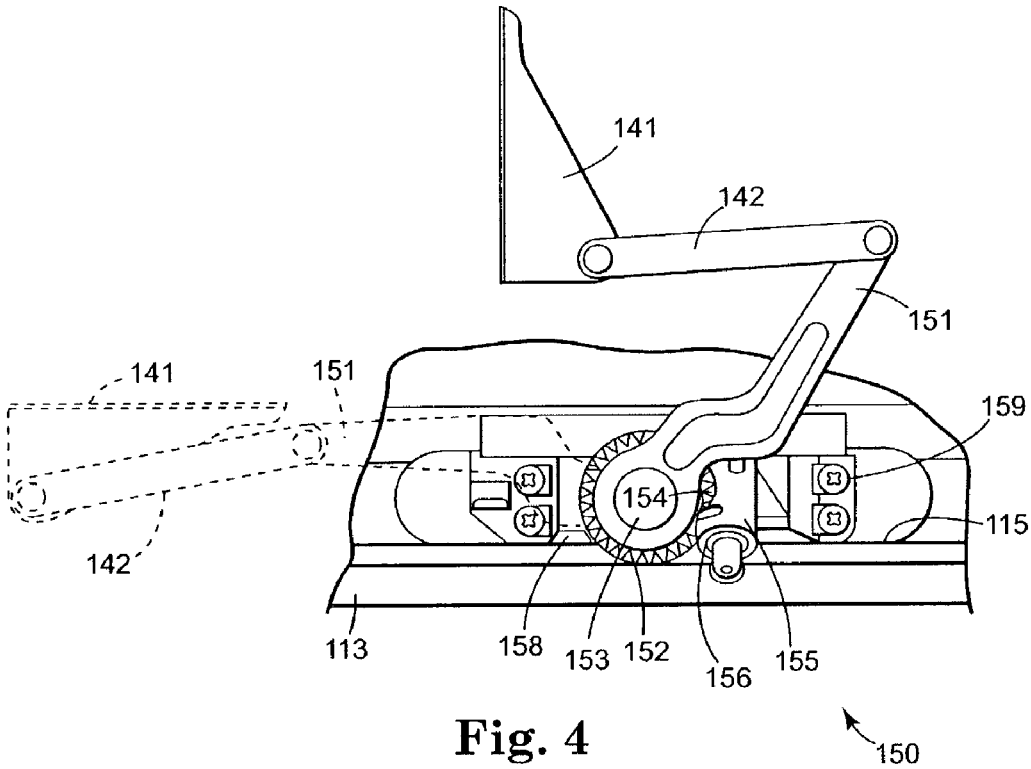
FIG. 4 is a top view of a sash drive mechanism configured for use with the window of FIG. 1.

Referring now also to FIG. 4, the sash drive mechanism 150 includes the link arm 151 pivotally coupled to the sash hinging mechanism 140 at a distal end. As shown, link arm 151 includes a curvilinear shape, but it is to be understood that other shapes may also be used to achieve the same results. At a proximal end, the link arm 151 is coupled to a generally flat helical gear 152 by a stud 153, such that the link arm 151 rotates in response to rotation of the helical gear 152. The sash drive mechanism 150 further includes a worm gear 154 contained within a generally cylindrical housing 155. Housing 155 and worm gear 154 are disposed immediately beside helical gear 152 and project upwardly and outwardly at an oblique angle to the plane of the sill 113. Housing 155 has a cutout in its sidewall that permits the worm gear 154 to engage and operably mesh with helical gear 152, such that rotation of the worm gear 154 results in rotation of the helical gear 152 and, thus, rotation of link arm 151. The resulting open (solid) and closed (dashed) positions of the link arm 151, linkage bar 142 and sash bracket 141 are shown. An input drive shaft 156 rigidly affixed to worm gear 154 projects axially therefrom beyond housing 155 for the purpose of supplying input driving power to sash drive mechanism 150.

The sash drive mechanism 150 also includes a housing 158 to which stud 153 is mounted for securing link arm 151 and helical gear 152. In one embodiment, the cylindrical housing 155 is integrally formed with housing 158, such as in a unitary die casting or other suitable structure. Housing 158 is then secured to sill 113 by a number of fasteners 159 within a cut out 115 formed within the sill 113. In one embodiment, a trim piece 116 (shown in FIGS. 1 and 2) is provided to generally cover over the sash drive mechanism 150 and portions of the sash hinging mechanism 140. The portions of the sash drive mechanism 150 which protrude from the sill 113 are, in turn, covered over by cover 300 for an aesthetically pleasing overall profile on window 100. For a more detailed description of sash hinging and drive mechanisms of this type, refer to co-pending and co-owned U.S. Patent Application Publication, Pub. No. US 2002/0066162 A1, published on Jun. 6, 2002, entitled CASEMENT WINDOW OPERATING ASSEMBLY HAVING FOLDING CRANK HANDLE, which is herein incorporated by reference in its entirety.

Figure 5:
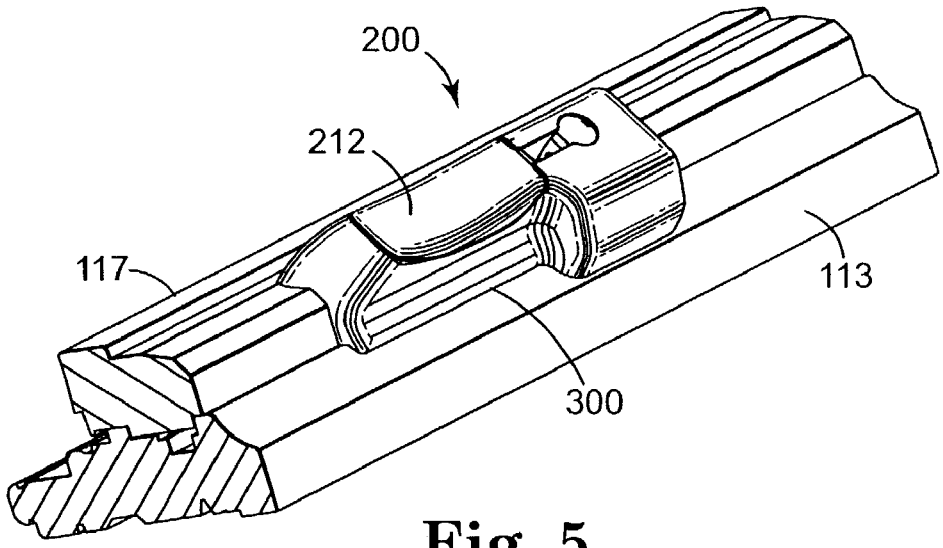
FIG. 5 is a partial perspective view of the sash operator and locking mechanism of FIG. 1, shown with the handle in a closed position.
Figure 6:
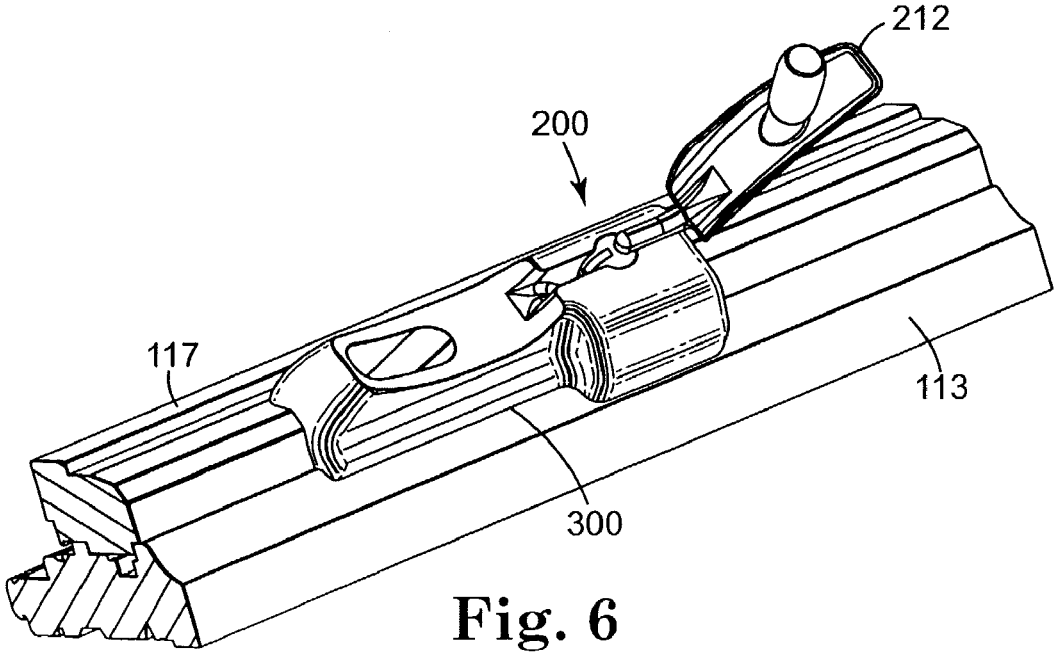
FIG. 6 is a partial perspective view of the sash operator and locking mechanism of FIG. 1, shown with the handle in an open position.

The novel window handle assembly 200 couples to the sash drive mechanism 150 at drive shaft 156 and engages the cover 300. Referring now to FIGS. 5 and 6, the window handle assembly 200 is shown in both the closed (FIG. 5) and open (FIG. 6) positions, such that a handle cover portion 212 is flush with or extends from cover 300, respectively. The cover 300 is configured to mount to the sill 113 and trim piece 117 for a smooth overall profile. No protrusions or other unsightly components of either the window handle assembly 200 or the sash drive mechanism 150 extend from the cover 300 when the window handle 200 is in the closed position, thereby minimizing the risk of damage to the handle/window unit, an operator or a passerby, as well as accidental opening of the sash at an undesired time.

Figure 7:
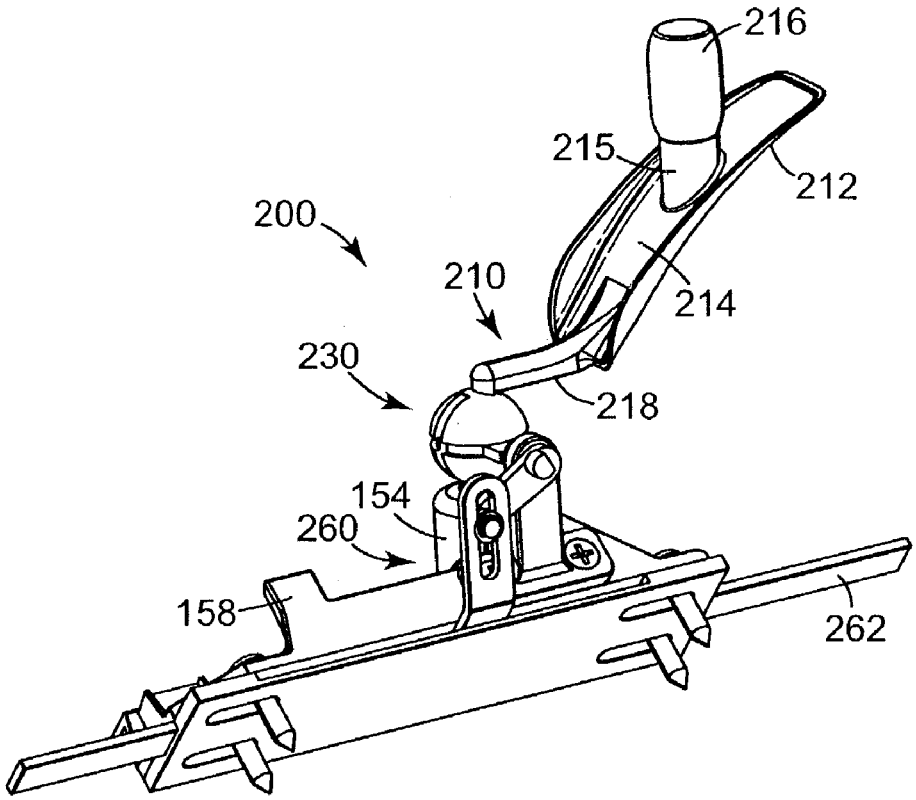
FIG. 7 is a perspective view of a window handle assembly in accordance with the present invention and usable with the sash drive mechanism of FIG. 4, shown with the handle in an open position.
Figure 8:
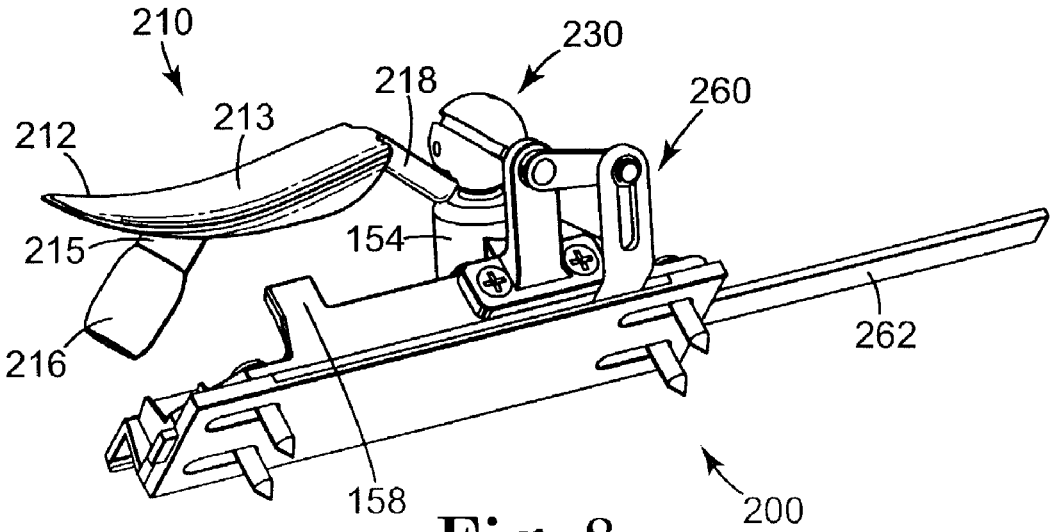
FIG. 8 is a perspective view of the window handle assembly of FIG. 7, shown with the handle in a closed position.
Figure 9:
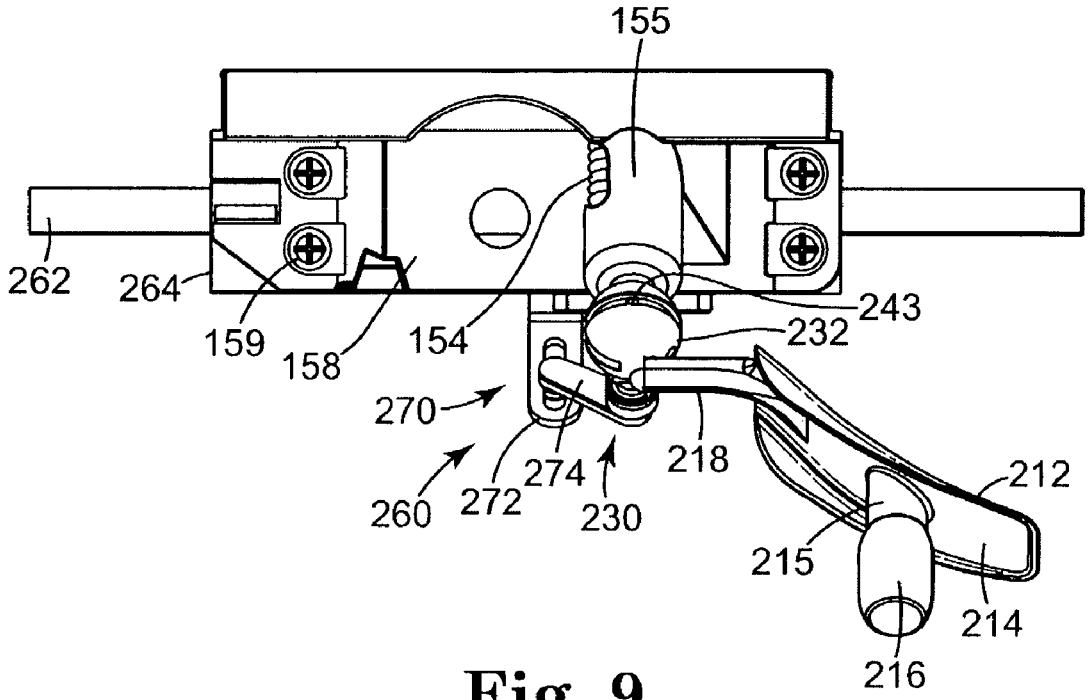
FIG. 9 is a top view of the window handle assembly of FIG. 7.
Figure 10:
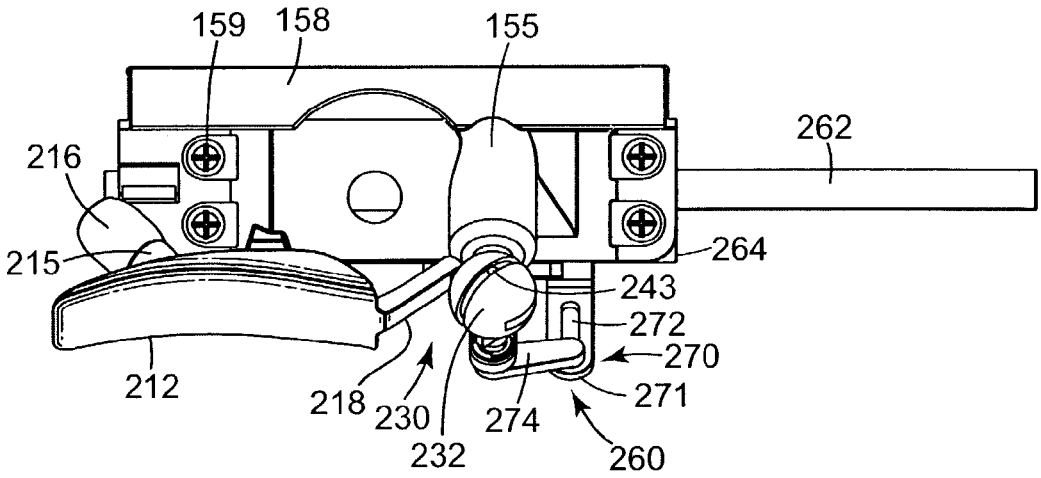
FIG. 10 is a top view of the window handle assembly of FIG. 8.
Figure 12:
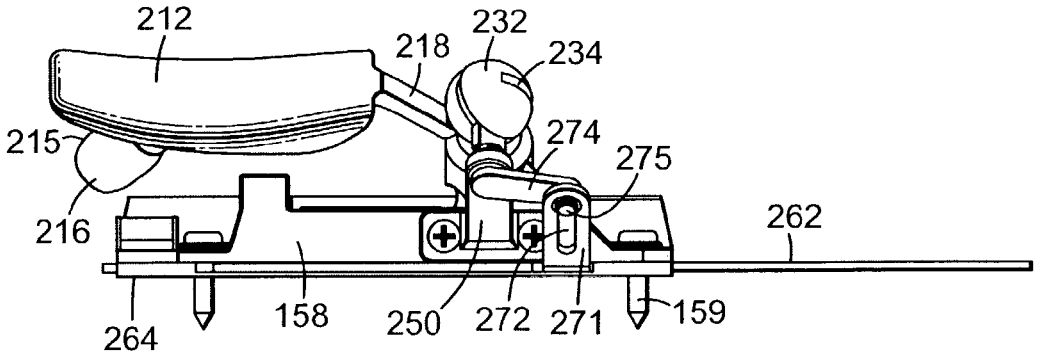
FIG. 12 is a front view of the window handle assembly of FIG. 10.
Figure 11:
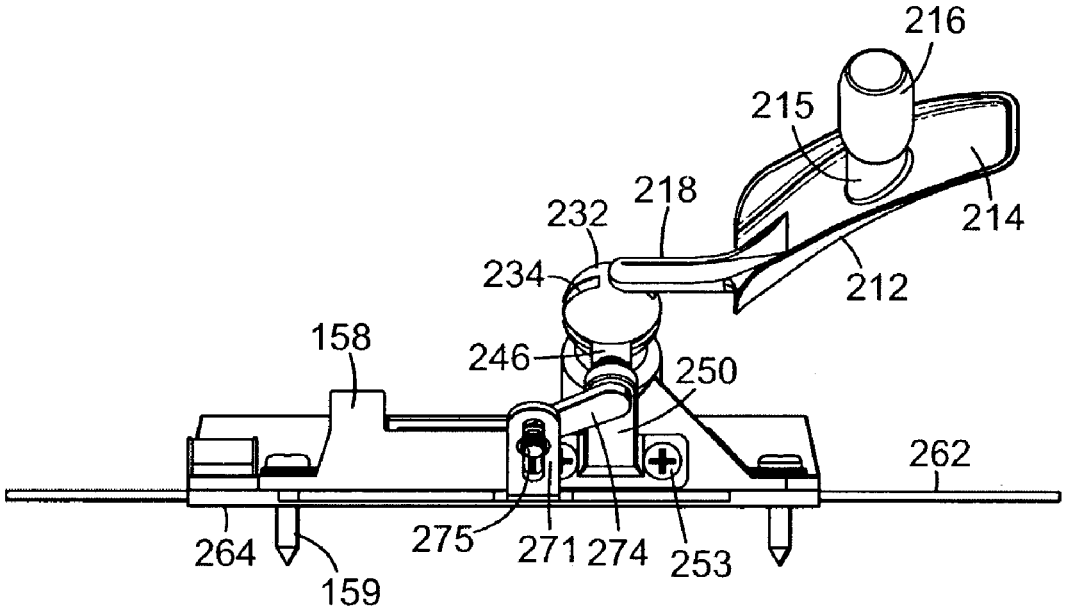
FIG. 11 is a front view of the window handle assembly of FIG. 9.
Figure 13:
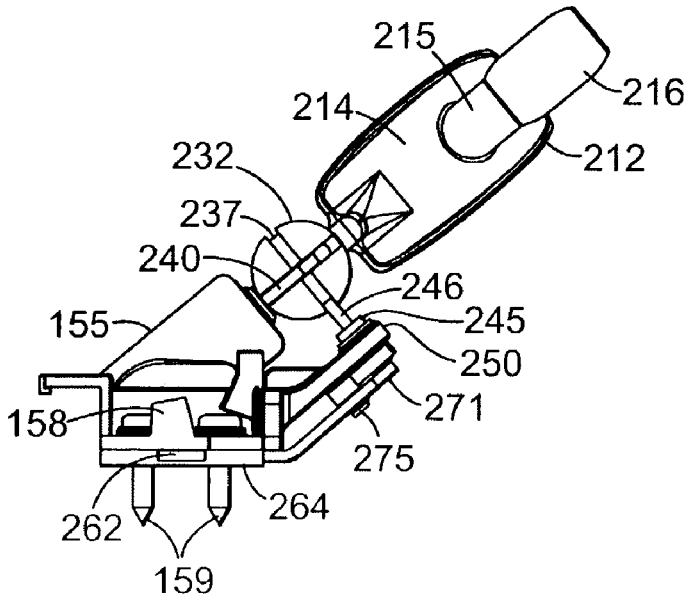
FIG. 13 is a left end view of the window handle assembly of FIG. 11.
Figure 14:
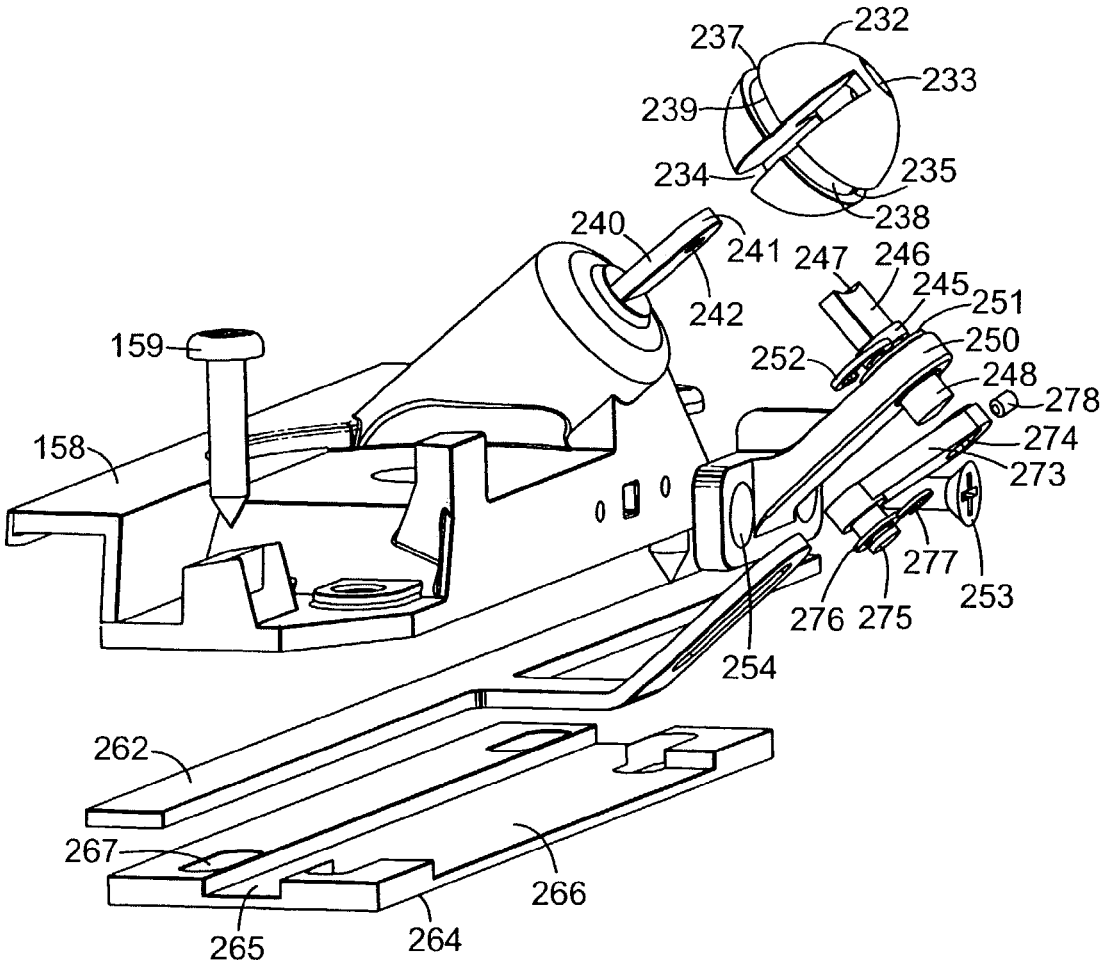
FIG. 14 is a partial exploded view of a pivot mechanism/window handle assembly in accordance with the present invention.

Referring now to FIGS. 7 and 8, the window handle assembly 200 of the present invention includes a window handle 210 coupled to a lock activating mechanism 260. The window handle assembly 200 functions as an interface between a user and the window 100, and provides for the operation of the sash 120 between open and closed positions, as well as the operation of the sash lock 160 between locked and unlocked positions, using only one overall mechanism. The lock activating mechanism 260 couples to the sash lock 160 via sliding bar 262 and provides the necessary movement to drive the hook 162 between the locked and unlocked positions. The window handle 210 couples to both the sash drive mechanism 150 and the lock activating mechanism 260, such that rotational movement of the window handle 210 drives the sash movement and pivotal movement drives the locking action through translational movement of the sliding bar 262 (as shown by comparison between FIGS. 7 and 8).

The window handle 210 includes the handle cover portion 212 configured with a contoured outer surface 213 that mates with the cover 300, providing the smooth, flush profile when closed, as shown in FIG. 5. On a side 214 opposite the outer surface 213, the handle cover portion 212 includes a knob 215 extending outward along an axis that is generally parallel to the axis of drive shaft 156. The far end of the knob 215 includes a rotatable portion 216 provided to facilitate rotation of the window handle 210 about the axis of the drive shaft 156 when grasped by a user.

The window handle 210 further includes a pivot mechanism 230 to which the handle cover portion 212 is connected by a connecting member 218. Referring now also to FIGS. 9-15, the pivot mechanism 230 includes a rotating pivot guide 232 coupled to the drive shaft 156. The rotating pivot guide 232 provides for the rotation of the handle cover portion 212, along with the pivoting movement of the handle cover portion 212 between the open and closed positions. In one embodiment, the rotating pivot guide 232 is configured as a generally spherical ball formed with an aperture 233 into which a portion of the connecting member 218 is inserted. It is to be understood, however, that other shapes and/or configurations of the pivot guide 232 are also possible to provide the same function within the window handle assembly 200. The aperture 233 may be keyed, pinned, shaped or otherwise formed to facilitate secure coupling of the connecting member 218, and thus the handle cover portion 212, to the pivot guide 232 without slippage during rotation of the handle cover portion 212.

The pivot guide 232 further includes a coupling slot 234 that is axially aligned and extends into the interior of the pivot guide 232, splitting the pivot guide 232 generally into two hemispheres for a majority of the depth of the pivot guide 232. The pivot guide 232 also has a circumferential groove 237 formed about the exterior at a centerline perpendicular to the plane of the coupling slot 234. The groove 237 includes a floor 238 and side walls 239. A pin hole 235 is also provided through the pivot guide 232 within the groove floor 238 and through the coupling slot 234. The axis of the pin hole 235 is offset from the plane of the coupling slot 234 by about 90 degrees.

The pivot mechanism 230 includes a coupling tab 240, which is connected to the drive shaft 156. In one embodiment, the coupling tab 240 is integrally formed with the drive shaft 156. Alternatively, the coupling tab 240 is separately formed and fastened to the drive shaft 156 in a suitable manner. In one embodiment, the coupling tab 240 is formed with a generally convex arcuate end surface 241 and includes a pin opening 242 that is preferably located at the center point of the radius of curvature for the arcuate end surface 241. The coupling tab 240 is positioned within the coupling slot 234 of the pivot guide 232 and rotatably held in position by a pin 243 passing through the pin hole 235 and pin opening 242. As a result, the pivot guide 232 is free to pivot within a limited range of motion over the coupling tab 240 about the axis of the pin 243. In addition, as the pivot guide 232 is rotated about the axis of the drive shaft 156, the coupling tab 240 also rotates, resulting in a corresponding rotation of the drive shaft 156 and worm gear 154, and operation of the sash drive mechanism 150 and sash hinging mechanism 140.

The pivot mechanism 230 further includes a lock drive shaft 245 operationally coupled to the rotating pivot guide 232 at the groove 237. At a first end of the shaft 245, a contoured tab 246 is formed having a generally concave end edge 247. Preferably, the radius of curvature of the tab edge 247 corresponds to the circumferential radius of the pivot guide 232. The tab 246 is positioned within the circumferential groove 237, adjacent to, but not in close contact with, the groove floor 238. The shaft 245, including tab 246, is held in place by shaft support 250, which is attached to housing 158 with fasteners 253 through holes 254, or by another suitable method. Alternatively, support for the shaft 245 may be formed as part of the housing 158. A washer 251 and snap ring 252 are provided to rotatably hold the shaft 245 in place. As the pivot guide 232 rotates, the contoured tab edge 247 rides in the groove 237, but does not interfere with the rotation of the pivot guide 232. However, when the pivot guide 232 is pivoted about the axis of pin 243, the side walls 239 of the groove 237 capture the tab 246 causing the shaft 245 to rotate within the shaft support 250. The far end 248 of shaft 245 protrudes from the shaft support 250 and provides a connection to the lock activating mechanism 260. The shaft end 248 may be shaped, keyed or otherwise configured for coupling to the lock activating mechanism 260 without slippage.

The lock activating mechanism 260 includes a slot cam 270 connecting the shaft 245 to sliding bar 262. As the shaft 245 rotates upon pivoting movement of the window handle 210, the slot cam 270 produces translational, linear movement of sliding bar 262, which is in turn coupled to sash lock 160. (Best shown in comparison between FIGS. 7 and 8, or FIGS. 9 and 10.) In one embodiment, the generally horizontal linear movement of the sliding bar 262 produces generally vertical movement of the sliding lock bar 164 by any of known suitable structures that provide for the transference of linear movement about a 90 degree turn. For example, see tilt/turn window technology, such as is popular in European windows. In particular, see for example, U.S. Pat. No. 5,095,614 to Kautt, entitled AUTOMATIC WINDOW FRAME LOCK ASSEMBLY INSTALLATION. Although the mechanism for transferring rotational to linear movement is shown in this embodiment as a slot cam, it is to be understood that other suitable mechanisms may also be used and are within the scope of the present invention. These include, for example, but not to be limited to, a rack and pinion system or a gear train.

The slot cam 270 includes an arm 273 having an aperture 274 into which the shaft end 248 is received. In this embodiment, the shaft end 248 and aperture are "D" shaped, with the arm 273 secured to the shaft end 248 by a set screw 278. At an opposite end of arm 273, a boss 275 is provided that protrudes outward on a side away from the shaft support 250. Boss 275 passes through a slotted aperture 272 formed within slot bar 271 that is connected to sliding bar 262. In one embodiment, the boss 275 includes a lip at an outer end upon which a washer 276 and retaining ring 277 are positioned to facilitate retention within, and smooth movement along, the slotted aperture 272 by the boss 275. The slot bar 271 is angled upward away from the sliding bar 262 at an oblique angle generally consistent with the angle of the worm gear 154 and drive shaft 156, and generally perpendicular to shaft 245. As the shaft 245 rotates, arm 273 and boss 275 also rotate causing the slot bar 271 to move linearly to accommodate the changing position of captured boss 275. Translational movement of the slot bar 271 results in corresponding translational movement of the sliding bar 262 and activation of the sash lock 160.

Figure 15:
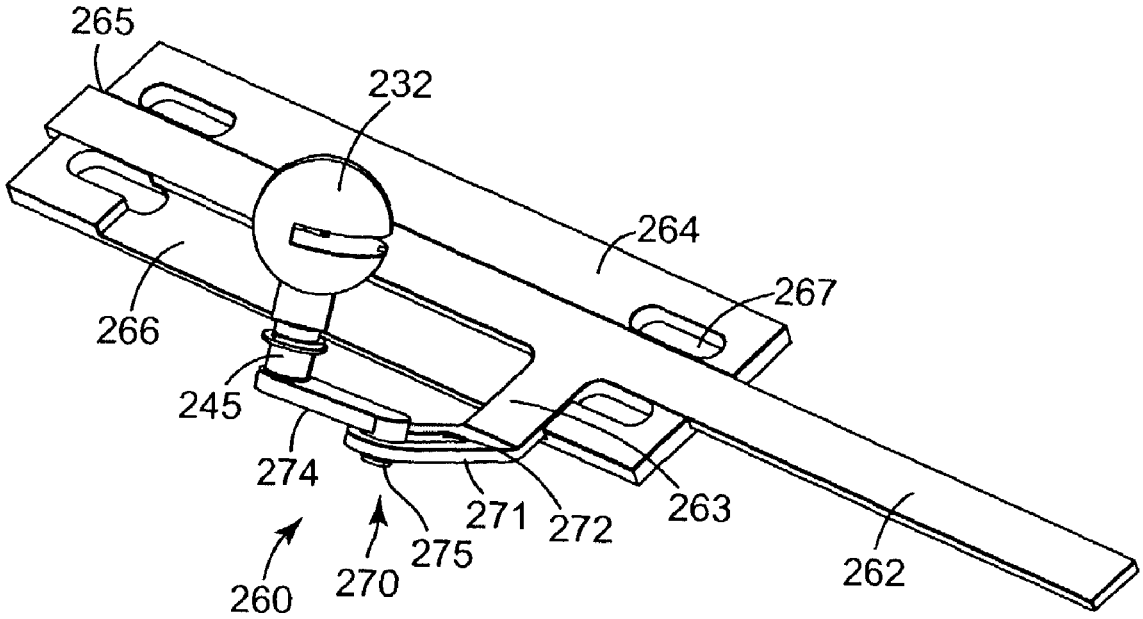
FIG. 15 is a partial perspective view of a lock activating mechanism in accordance with the present invention.

Sliding bar 262 is supported in a base 264 configured to facilitate smooth sliding action of the sliding bar 262 within the linear range of movement provided by the slot cam 270. The base 264 effectively sandwiches the sliding bar 262 between it and the housing 158. A plurality of slotted apertures 267 are provided to accommodate passage of the fasteners 159 securing the housing 158 to the sill 115. As shown in FIG. 15, the base 264 includes a generally 'T' shaped groove with a narrow cross portion 265 into which the sliding bar 262 is received and a wide base portion 266 that extends to an edge of the base 264. A connecting member 263 joins the sliding bar 262 to the slot bar 271 and rides within the groove base area 267. In one embodiment, the sliding bar 262, connecting member 263 and slot bar 271 are integrally formed as one piece. However, it is to be understood that separate components joined or otherwise coupled together are also usable and within the scope of the present invention.

In operation, a closed and locked window 100 has the window handle 210 in its first, closed position (FIG. 5). A user lifts and pivots the window handle 210 away from the cover 300 to its second, open position (FIG. 6). The pivoting motion results in the unlocking of the sash lock 160 by movement of the sliding bar 262. The user may then rotate the window handle 210 by grasping the knob end 216. Rotation of the window handle 210 results in rotation of the drive shaft 156 and worm gear 154 causing the sash hinging mechanism 140 to swing the sash 120 open a desired amount depending on the amount of handle rotation. Pivoting movement of the window handle 210 from its open position to the closed position again causes movement of the sliding bar 262, this time resulting in the locking of the sash lock 160. Once the window handle 210 is in its second, closed position, it cannot be rotated and no motion of the sash 210 is possible.

If the sash 120 is in an open position at the time of the locking action, the hook 162 does not engage the lock receptor 166. Since the window handle 210 must be again moved to the open position in order to swing the sash closed, the sash lock 160 will be ready to engage the hook 162 within the receptor 166 upon closing of the sash 120.

When desired, the user pivots the window handle 210 into the open position and rotates it in an opposite direction so as the swing the sash 120 closed. Once closed, the window handle 210 is again pivoted into its first, closed position, thereby activating the sash lock 160 and locking the sash with respect to the window frame 110. As is clear, the opening/closing and locking/unlocking functions normally provided for windows having moveable sashes are accomplished with only one efficient mechanism. The window handle assembly thus simplifies the use of the window and minimizes the possibility of forgetting to lock the window, all the while providing an aesthetically pleasing window unit.

All patents and patent applications disclosed herein, including those disclosed in the background of the invention, are hereby incorporated by reference. Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. A window handle assembly for use with a window having a moveable sash and operable to activate a sash lock, the assembly comprising:

a window handle including a pivot mechanism, the window handle pivotable about a single axis between first and second positions at the pivot mechanism, in the first position the window handle is open and rotatable to move the sash and in the second position the window handle is closed, the pivot mechanism restricting pivotal movement of the handle between the first and second positions to a single plane that intersects with a recess in the window handle assembly, the recess being adapted to receive at least a portion of the handle in the second position; and a lock activating mechanism coupled to the window handle pivot mechanism and operationally couplable to the sash lock, the lock activating mechanism configured to always activate the sash lock when the window handle is in the second position, such that the sash lock is in an unlocked configuration when the window handle is in the first position and is in a locked configuration when the window handle is in the second position.

2. The window handle assembly of claim 1, further comprising a cover that overlies and encloses the lock activating mechanism, the cover configured to accommodate rotation of the window handle when in the first position and movement of the window handle between the first and second positions, the cover further configured to engage the window handle in the second position.

3. The window handle assembly of claim 2, wherein the window handle is contoured and the cover is matingly contoured to receive the window handle with a resulting generally flush outer cover surface.

4. The window handle assembly of claim 1, wherein the window handle comprises a knob to facilitate grasping and rotating the window handle.

5. The window handle assembly of claim 4, further comprising a cover that overlies and encloses the lock activating mechanism, the cover including the recess configured to receive the handle knob when the window handle is in the second position.

6. The window handle assembly of claim 1, wherein the lock activating mechanism comprises a sliding bar coupled to the pivot mechanism, such that pivoting of the window handle between the first and second positions results in generally linear displacement of the sliding bar.

7. The window handle assembly of claim 6, wherein the lock activating mechanism further comprises a movement mechanism coupled between the sliding bar and the pivot mechanism.

8. The window handle assembly of claim 7, wherein the movement mechanism comprises a slot cam that couples the sliding bar to the pivot mechanism.

9. The window handle assembly of claim 8, wherein the slot cam comprises:

an arm coupled to the pivot mechanism and configured to rotate in response to pivoting movement of the window handle;

a slot bar connected to the sliding bar and including a slotted aperture; and a boss connected to the arm and positioned to ride in the slotted aperture, such that rotation of the arm results in movement of the boss within the slotted aperture and generally linear displacement of the sliding bar.

10. The window handle assembly of claim 9, wherein the slot bar and sliding bar are integrally formed as a generally 'T' shaped bar with the slot bar generally perpendicular to the sliding bar, the slot bar formed at an oblique angle with respect to the sliding bar.

11. The window handle assembly of claim 9, wherein the pivot mechanism comprises a rotating pivot glide couplable to a rotational drive for movement of the sash and a shaft engaged with the rotating pivot guide and coupled to the lock activating mechanism, and wherein the shaft includes a shaft end connected to the arm first end, such that pivoting of the pivot guide results in rotation of the shaft and arm.

12. The window handle assembly of claim 7, wherein the movement mechanism comprises a gear train coupled between the pivot mechanism and the sliding bar.

13. The window handle assembly of claim 7, wherein the movement mechanism comprises a rack and pinion mechanism coupled between the pivot mechanism and the sliding bar.

14. The window handle assembly of claim 6, further comprising a base configured to receive the sliding bar and provide a predetermined range of sliding movement.

15. The window handle assembly of claim 1, wherein the pivot mechanism rotates in response to rotatiion of the window handle.

16. The window handle assembly of claim 1, wherein the pivot mechanism comprises a rotating pivot guide couplable to a rotational drive for movement of the sash and coupled to the lock activating mechanism.

17. The window handle assembly of claim 16, wherein the rotating pivot guide is configured to freely rotate about a first axis and to pivot within a predetermined range about a second axis that is generally perpendicular to the first axis.

18. The window handle assembly of claim 17, wherein the first axis corresponds to an axis of rotation of the rotational drive for movement of the sash.

19. The window handle assembly of claim 17, wherein the pivot guide comprises a coupling slot configured to receive a coupling tab that is connected to a drive shaft of the rotation drive and a transverse groove formed about the external surface of the pivot guide in a plane generally perpendicular to a plane of the coupling slot, the transverse groove configured to receive a shaft tab positioned to ride within the groove during rotation of the pivot guide about the first axis and to be rotated during pivoting of the pivot guide about the second axis.

20. The window handle assembly of claim 19, wherein the pivot guide further comprises a pin hole formed within the transverse groove and extending through the pivot guide in alignment with the second axis and wherein the coupling tab further comprises a pin opening configured to be positioned in alignment with the pin hole when the coupling tab is received within the coupling slot, such that a pin is receivable within the pin hole so as to rotatably connect the pivot guide to the coupling tab about the second axis.

21. The window handle assembly of claim 19, wherein the shaft tab comprises a contoured tab end configured to matingly correspond to the transverse groove so as to freely ride within the groove during rotation of the pivot guide.

22. The window handle assembly of claim 16, wherein the pivot mechanism further comprises a coupling tab mountable to the rotational drive and connected to the rotating pivot guide.

23. The window handle assembly of claim 16, wherein the pivot mechanism further comprises a shaft engaged with the rotating pivot guide and coupled to the lock activating mechanism.

24. The window handle assembly of claim 23, wherein the pivot guide includes a convex contour and wherein an end of the shaft includes a matingly concave contour.

25. The window handle assembly of claim 1, further comprising a drive mechanism for sash movement and wherein the pivot mechanism is coupled to the drive mechanism so as to impart rotational movement to the drive mechanism upon rotation of the window handle.

26. The window handle assembly of claim 1, further comprising a lock mechanism for sash locking and wherein the lock activating mechanism is coupled to the lock mechanism so as to activate and deactivate the lock mechanism upon pivoting movement of the window handle.

27. A window comprising:

a frame;

a sash moveable with respect to the frame;

a sash movement mechanism coupled to the sash and the frame, the sash movement mechanism configured to move the sash relative to the frame;

a sash lock configured to lock the sash to the frame so that the sash cannot move with respect the frame;

a window handle including a pivot mechanism, the window handle pivotable about a single axis between first and second positions at the pivot mechanism and coupled to the sash movement mechanism, in the first position the window handle is open and rotatable to move the sash and in the second position the window handle is closed, the pivot mechanism restricting pivotal movement of the handle between the first and second positions to a single plane that intersects with a recess in the window handle assembly, the recess being adapted to receive at least a portion of the handle in the second position; and a lock activating mechanism coupled to the window handle pivot mechanism and operationally coupled to the sash lock, the lock activating mechanism configured to always activate the sash lock when the window handle is in the second position, such that the sash lock is unlocked when the window handle is in the first position and is locked when the window handle is in the second position.

28. The window of claim 27, further comprising a cover that overlies and encloses the lock activating mechanism, the cover configured to accommodate rotation of the window handle when in the first position and movement of the window handle between the first and second positions, the cover further configured to engage the window handle in the second position.

29. The window of claim 28, wherein the window handle is contoured and the cover is matingly contoured to receive the window handle with a resulting generally flush outer cover surface.

30. The window of claim 27, wherein the window handle comprises a knob to facilitate grasping and rotating the window handle.

31. The window of claim 27, wherein the lock activating mechanism comprises a sliding bar coupled to the pivot mechanism, such that pivoting of the window handle between the first and second positions results in generally linear displacement of the sliding bar.

32. The window of claim 31, wherein the lock activating mechanism further comprises a movement mechanism coupled between the sliding bar and the pivot mechanism.

33. The window of claim 32, wherein the movement mechanism comprises a slot cam that couples the sliding bar to the pivot mechanism.

34. The window of claim 33, wherein the slot cam comprises:

an arm coupled to the pivot mechanism and configured to rotate in response to pivoting movement of the window handle;

a slot bar connected to the sliding bar and including a slotted aperture; and a boss connected to the arm and positioned to ride in the slotted aperture, such that rotation of the arm results in movement of the boss within the slotted aperture and generally linear displacement of the sliding bar.

35. The window of claim 32, wherein the movement mechanism comprises a gear train coupled between the pivot mechanism and the sliding bar.

36. The window of claim 32, wherein the movement mechanism comprises a rack and pinion mechanism coupled between the pivot mechanism and the sliding bar.

37. The window of claim 31, further comprising a base configured to receive the sliding bar an provide a predetermined range of sliding movement.

38. The window of claim 27, wherein the pivot mechanism rotates in response to rotation of the wirdow handle.

39. The window of claim 27, wherein the pivot mechanism comprises a rotating pivot guide couplable to a rotational drive for movement of the sash and coupled to the lock activating mechanism.

40. The window of claim 39, wherein the rotating pivot guide is configured to freely rotate about a first axis and to pivot within a predetermined range about a second axis that is generally perpendicular to the first axis.

41. The window of claim 40, wherein the first axis corresponds to an axis of rotation of the rotational drive for movement of the sash.

42. The window of claim 40, wherein the pivot guide comprises a coupling slot configured to receive a coupling tab that is connected to a drive shaft of the rotation drive and a transverse groove formed about the external surface of the pivot guide in a plane generally perpendicular to a plane of the coupling slot, the transverse groove configured to receive a shaft tab positiotied to ride within the groove during rotation of the pivot guide about the first axis and to be rotated during pivoting of the pivot guide about the second axis.

43. The window of claim 42, wherein the pivot guide further comprises a pin hole formed within the transverse groove and extending through the pivot guide in alignment with the second axis and wherein the coupling tab further comprises a pin opening configured to be positioned in alignment with the pin hole when the coupling tab is received within the coupling slot, such that a pin is receivable within the pin hole so as to rotatably connect the pivot guide to the coupling tab about the second axis.

44. The window of claim 42, wherein the shaft tab comprises a contoured tab end configured to matingly correspond to the transverse groove so as to freely ride within the groove during rotation of the pivot guide.

45. The window of claim 39, wherein the pivot mechanism further comprises a coupling tab mountable to the rotational drive and connected to the rotating pivot guide.

46. The window of claim 39, wherein the pivot mechanism further comprises a shaft engaged with the rotating pivot guide and coupled to the lock activating mechanism.

47. The window of claim 46, wherein the pivot guide includes a convex contour and wherein an end of the shaft includes a matingly concave contour.

48. A combination sash operator and locking mechanism for a window having a movable sash and a sash lock, the combination sash operator and locking mechanism comprising:

a sash movement mechanism couplable to the sash so as to cause the sash to move between open and closed positions when the sash movement mechanism is operated;

a window handle including a pivot mechanism coupled to the sash movement mechanism, the window handle pivotable about a single axis between first and second positions at the pivot mechanism, in the first position the window handle is open and rotatable to move the sash by rotation of the pivot mechanism and in the second position the window handle is closed, the pivot mechanism restricting pivotal movement of the handle between the first and second positions to a single plane that intersects with a recess in the window handle assembly, the recess being adapted to receive at least a portion of the handle in the second position;

a lock activating mechanism coupled to the window handle pivot mechanism and operationally couplable to the sash lock, the lock activating mechanism configured to always activate the sash lock when the window handle is in the second position, such that the sash lock is in an unlocked configuration when the window handle is in the first position and is in a locked configuration when the window handle is in the second position; and a cover configured to overlie and enclose portions of the sash movement mechanism and lock activating mechanism, the cover engaged with the window handle in both the first and second positions so as to accommodate rotation of the window handle when in the first position and movement of the window handle between the first and second positions, the cover and window handle matingly configured to provide a generally flush outer cover surface when the window handle is in the second position.

49. The combination sash operator and locking mechanism of claim 48, wherein the window handle comprises a knob to facilitate grasping and rotation of the window handle and wherein the cover comprises the recess configured to receive the knob when the window handle is in the second position.

50. The combination sash operator and locking mechanism of claim 48, wherein the lock activating mechanism comprises a sliding bar coupled to a movement mechanism that is coupled to the pivot mechanism, such that pivoting of the window handle between the first and second positions results in generally linear displacement of the sliding bar.

51. The combination sash operator and locking mechanism of claim 50, wherein the movement mechanism comprises a slot cam that couples the sliding bar to the pivot mechanism, the slot cam comprising:

an arm coupled to the pivot mechanism and configured to rotate in response to pivoting movement of the window handle;

a slot bar connected to the sliding bar and including a slotted aperture; and a boss connected to the arn and positioned to ride in the slotted aperture, such that rotation of the arm results in movement of the boss within the slotted aperture and generally linear displacement of the sliding bar.

52. The combination sash operator and locking mechanism of claim 51, wherein the pivot mechanism comprises a rotating pivot guide coupled to the sash movement mechanism, and a shaft engaged with the rotating pivot guide and coupled to the lock activating mechanism, and wherein the shaft includes a shaft end connected to the arm first end, such that pivoting of the pivot guide results in rotation of the shaft and arm.

53. The combination sash operator and locking mechanism of claim 50, further comprising a base configured to receive the sliding bar and provide a predetermined range of sliding movement.

54. The combination sash operator and locking mechanism of claim 48, wherein the pivot mechanism comprises a rotating pivot guide coupled to both the sash movement mechanism and the lock activating mechanism.

55. The combination sash operator and locking mechanism of claim 54, wherein the sash movement mechanism further includes a drive shaft, wherein the rotating pivot guide is configured to freely rotate about a first axis aligned with the drive shaft and to pivot within a predetermined range about a second axis that is generally perpendicular to the first axis.

56. The combination sash operator and locking mechanism of claim 55, wherein the pivot guide comprises a coupling slot configured to receive a coupling tab that is connected to the drive shaft of the sash movement mechanism and a transverse groove formed about the external surface of the pivot guide in a plane generally perpendicular to a plane of the coupling slot, the transverse groove configured to receive a shaft tab positioned to ride within the groove during rotation of the pivot guide about the first axis and to be rotated during pivoting of the pivot guide about the second axis.

57. The combination sash operator and locking mechanism of claim 56, wherein the pivot guide further comprises a pin hole formed within the transverse groove and extending through the pivot guide in alignment with the second axis and wherein the coupling tab further comprises a pin opening configured to be positioned in alignment with the pin hole when the coupling tab is received within the coupling slot, such that a pin is receivable within the pin hole so as to rotatably connect the pivot guide to the coupling tab about the second axis.

58. The combination sash operator and locking mechanism of claim 57, wherein the shaft tab comprises a contoured tab end configured to matingly correspond to the transverse groove so as to freely ride within the groove during rotation of the pivot guide.

59. A window handle assembly for use with a window having a moveable sash and a sash lock, the assembly comprising:

a window handle including a pivot mechanism, the window handle pivotable about a single axis between fist and second positions at the pivot mechanism, in the first position the window handle is open and rotatable to move the sash and in the second position the window handle is closed, the pivot mechanism restricting pivotal movement of the handle between the first and second positions to a single plane that intersects with a recess in the window handle assembly, the recess being adapted to receive at least a portion of the handle in the second position; and a lock activating mechanism coupled to the window handle pivot mechanism and operationally couplable to the sash lock, the lock activating mechanism configured to activate the sash lock upon pivoting movement of the window handle from the first position to the second position, such that the sash lock is in an unlocked configuration when the window handle is in the first position and is in a locked configuration when the window handle is in the second position, wherein the pivot mechanism comprises a rotating pivot guide mechanically engaged to a rotational drive for movement of the sash and mechanically engaged to the lock activating mechanism.

60. The window handle assembly of claim 59, wherein the rotating pivot guide is configured to freely rotate about a first axis and to pivot within a predetermined range about a second axis that is generally perpendicular to the first axis.

61. The window handle assembly of claim 60, wherein the first axis corresponds to an axis of rotation of the rotational drive for movement of the sash.

* * * * *

UNITED STATES PATENT AND TRADEMARK OFFICE

CERTIFICATE OF CORRECTION

PATENT NO. : 7,066,505 B2
APPLICATION NO. : 10/393473
DATED : June 27, 2006
INVENTOR(S) : Marlo G. Van Klompenburg et al.

It is certified that error appears in the above-identified patent and that said Letters Patent is hereby corrected as shown below:

Column 8

Line 61, delete “glide” and replace it with -- guide --

Column 9

Line 12, delete “rotatiion” and replace it with -- rotation --

Column 11

Line 8, delete “an” and replace it with -- and --

Line 29, delete “positiotied” and replace it with -- positioned --

Line 56, delete “movable” and replace it with -- moveable --

Column 12

Line 48, delete “arn” and replace it with -- arm --

Column 14

Line 2, delete “fist” and replace it with -- first --

Signed and Sealed this

Nineteenth Day of December, 2006

JON W. DUDAS
*Director of the United States Patent and Trademark Office*